US007495534B2

(12) United States Patent
Oh

(10) Patent No.: US 7,495,534 B2
(45) Date of Patent: Feb. 24, 2009

(54) TERMINAL MODULE ASSEMBLY FOR MOLDED CASE CIRCUIT BREAKER AND MOLDED CASE CIRCUIT BREAKER HAVING THE SAME

(75) Inventor: Ki-Hwan Oh, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 93 days.

(21) Appl. No.: 11/752,421

(22) Filed: May 23, 2007

(65) Prior Publication Data

US 2008/0157906 A1 Jul. 3, 2008

(30) Foreign Application Priority Data

Dec. 29, 2006 (KR) ..... 10-2006-0139131

(51) Int. Cl.
*H01H 71/08* (2006.01)
*H01H 73/20* (2006.01)

(52) U.S. Cl. ..... 335/6; 335/132; 335/133; 335/202

(58) Field of Classification Search ..... 335/6, 335/132, 133, 202; 439/650, 723, 724, 810, 439/814

See application file for complete search history.

(56) References Cited

U.S. PATENT DOCUMENTS 4,736,177 A * 4/1988 Vollmer et al. ..... 335/299
6,144,001 A 11/2000 Green et al.
6,172,586 B1 1/2001 Ferree et al.
7,132,913 B2 * 11/2006 Whipple et al. ..... 335/202
2005/0270130 A1 * 12/2005 Roesner et al. ..... 335/132
2006/0077023 A1 4/2006 Oh
2007/0075047 A1 4/2007 Oh

FOREIGN PATENT DOCUMENTS

JP 2126529 5/1990
KR 2006-0087344 8/2006

OTHER PUBLICATIONS

U.S. Appl. No. 11/752,661 to Oh, which was filed on May 23, 2007.
English language Abstract of KR 2006-0087344.
English language Abstract of JP 2-126529.

* cited by examiner

*Primary Examiner*—Ramon M Barrera
(74) *Attorney, Agent, or Firm*—Greenblum & Bernstein, P.L.C.

(57) ABSTRACT

In a terminal of a standard, plug-in or box type molded case circuit breaker, a terminal module assembly for a molded case circuit breaker capable of being removable by easily selecting the terminal type, and a molded case circuit breaker having the terminal module assembly, the terminal module assembly comprising a plurality of terminals provided to selectively have a standard, plug-in or box type and electrically connected to fixed contactors, a plurality of terminal bases provided as many as the number of the terminals and selectively having the standard, plug-in or box type, thus to fixedly support each of the terminals, wherein each terminal is assembled to each terminal base to obtain a terminal module intermediate assembly, and a common supporting base for supporting all of the plurality of intermediate assemblies regardless of the terminal type or terminal base type, wherein the terminal module assemblies having the construction can be attached/detached to/from the molded case circuit breaker.

4 Claims, 9 Drawing Sheets

TERMINAL MODULE ASSEMBLY FOR MOLDED CASE CIRCUIT BREAKER AND MOLDED CASE CIRCUIT BREAKER HAVING THE SAME

RELATED APPLICATION

The present disclosure relates to a subject matter contained in priority Korean Application No. 10-2006-0139131, filed on Dec. 29, 2006, which is herein expressly incorporated by reference in its entirety.

BACKGROUND OF THE INVENTION

1. Field of the Invention

The present invention relates to a molded case circuit breaker, and particularly, to a terminal module assembly for a molded case circuit breaker in which a terminal part of the molded case circuit breaker is constructed as a module assembly to allow a fast replacement of a terminal module, so that a type of terminal (e.g., a standard type, a plug-in type or a box type) can be fast changed.

2. Background of the Invention

In general, a molded case circuit breaker is an electrical device for protecting circuit and electrical loads by automatically breaking the electrical circuit upon occurring a fault current, such as over-current, ground fault current or short-circuit current, on the electrical circuit.

A molded case circuit breaker generally comprises a terminal part which connects a power source or an electrical load of the circuit, a switching mechanism which switches the circuit by contacting a fixed contact with a movable contact or separate them from each other within the molded case circuit breaker, and a trip mechanism which senses a fault current to trip the switching mechanism to a circuit-broken position.

The terminal part, for example, comprises an outer protrusion of the fixed contact and a terminal. The types of the terminal may include a box type terminal which is mostly used when wires at the power source side circuit and the load side circuit have "ring-shaped" terminals or "U-shaped" terminals, a plug-in type terminal which is used when the molded case circuit breaker is connected to the circuit by inserting the terminal into a terminal insertion hole on a plug-in base, and a standard type terminal as a typical bar-shaped terminal which is commonly used when wires in the circuit have a circular section.

Manufacturers of molded case circuit breakers manufacture the related art terminals monolithically with the molded case circuit breaker, without separately providing only the terminals. Accordingly, when the type of terminal should be changed according to an installation environment of the molded case circuit breaker, a user should purchase the whole molded case circuit breaker having the same type of terminal that he wants to get, in order to replace only the terminal.

To solve the inconvenience, the applicant of this invention has proposed a module-type terminal structure such as "module-type terminal structure of molded case circuit breaker" (Korean Patent Laid Open No. 2006-0087344, open date: Aug. 2, 2006).

By adapting the module-type terminal structure of the molded case circuit breaker proposed by the applicant of this application, the user does not have to purchase the whole molded case circuit breaker in order to replace only the type of terminal he desires to get. However, in case of a typical 3-phases Alternating Current molded case circuit breaker, when assembling each of 6 terminal modules (i.e., 3 terminal modules respectively at the load side and the power source side) to the molded case circuit breaker using screws, it takes long time and it is inconvenient for both of manufacturer and user.

Furthermore, the terminal module itself is a merely small component about several tens millimeters. Accordingly, it is difficult to separately fabricate, package and sell the terminal module. Also, the user may be in trouble for assembling the small component to the molded case circuit breaker.

In addition, the molded case circuit breaker may be restricted only to molded case circuit breakers which have, for example, a rail-mounted connection structure such that the replaceable terminal module can be connected thereto.

SUMMARY OF THE INVENTION

Therefore, in order to solve the drawbacks of the related art, an aspect of the present invention is to provide a terminal module assembly of a molded case circuit breaker capable of allowing manufacturers to fabricate, package and sell a terminal module and also allowing users to easily replace only the terminal module with his desired type, by constructing the terminal module as a 3-phases monolithic assembly for a power source side or a load side of the molded case circuit breaker.

Another aspect of the present invention is to provide a molded case circuit breaker having the terminal module assembly.

Still another aspect of the present invention is to provide a terminal module assembly of a molded case circuit breaker capable of being constructed according to an installation environment of the molded case circuit breaker by assembling terminal modules into the terminal module assembly according to each phase or a power source or load side circuit in various combinations, and a molded case circuit breaker having the terminal module assembly.

To achieve these and other advantages and in accordance with the purpose of the present invention, as embodied and broadly described herein, there is provided a terminal module assembly for a molded case circuit breaker connected to fixed contactors of the molded case circuit breaker comprising: a plurality of terminals which are provided as many as the number of the fixed contactors provided each phase, and electrically connected to the fixed contactors, wherein each of the plurality of terminals selectively has a standard type, a plug-in type and a box type; a plurality of terminal base which are provided as many as the number of the terminals for fixedly supporting each of the terminals, and provided to selectively have the standard type, the plug-in type and the box type corresponding to the types of the terminals selected from the standard type, the plug-in type and the box type, wherein each terminal and the each terminal base are assembled to each other to obtain a terminal module intermediate assembly; and one common supporting base which supports all the intermediate assemblies regardless of the type of the terminal or terminal base, wherein the intermediate assemblies are assembled to the common supporting base to obtain a complete terminal module assembly, such that the standard, plug-in or box type terminal module assembly is selectively able to be mounted in the molded case circuit breaker or separated from the molded case circuit breaker without opening the case of the molded case circuit breaker.

In another aspect of the present invention, there is provided A molded case circuit breaker having a terminal module assembly comprising: a plurality of fixed contactors which are provided according to each phase and have end portions protruded to the outside of the molded case circuit breaker so as to be connected to a power source or load side wires; and a terminal module assembly which is electrically connected to the end portions of the fixed contactors and selectively has a standard type, a plug-in type or a box type to be mounted in the molded case circuit breaker or separated therefrom, wherein the terminal module assembly comprises: a plurality of terminals which are provided to selectively have the standard type, the plug-in type and the box type corresponding to the types of the plurality of fixed contactors, and electrically connected to the end portions of the fixed contactors; a plurality of terminal bases which are provided as many as the number of the terminals for fixedly supporting each of the terminals, and provided to selectively have the standard type, the plug-in type and the box type corresponding to the types of the terminals selected from the standard type, the plug-in type and the box type, wherein each terminal and the each terminal base are assembled to each other to obtain a terminal module intermediate assembly; and one common supporting base which supports all the intermediate assemblies regardless of the type of the terminal or terminal base, wherein the intermediate assemblies are assembled to the common supporting base to obtain a complete terminal module assembly, such that the standard, plug-in or box type terminal module assembly is selectively able to be mounted in the molded case circuit breaker or separated from the molded case circuit breaker without opening the case of the molded case circuit breaker.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Figure 1:
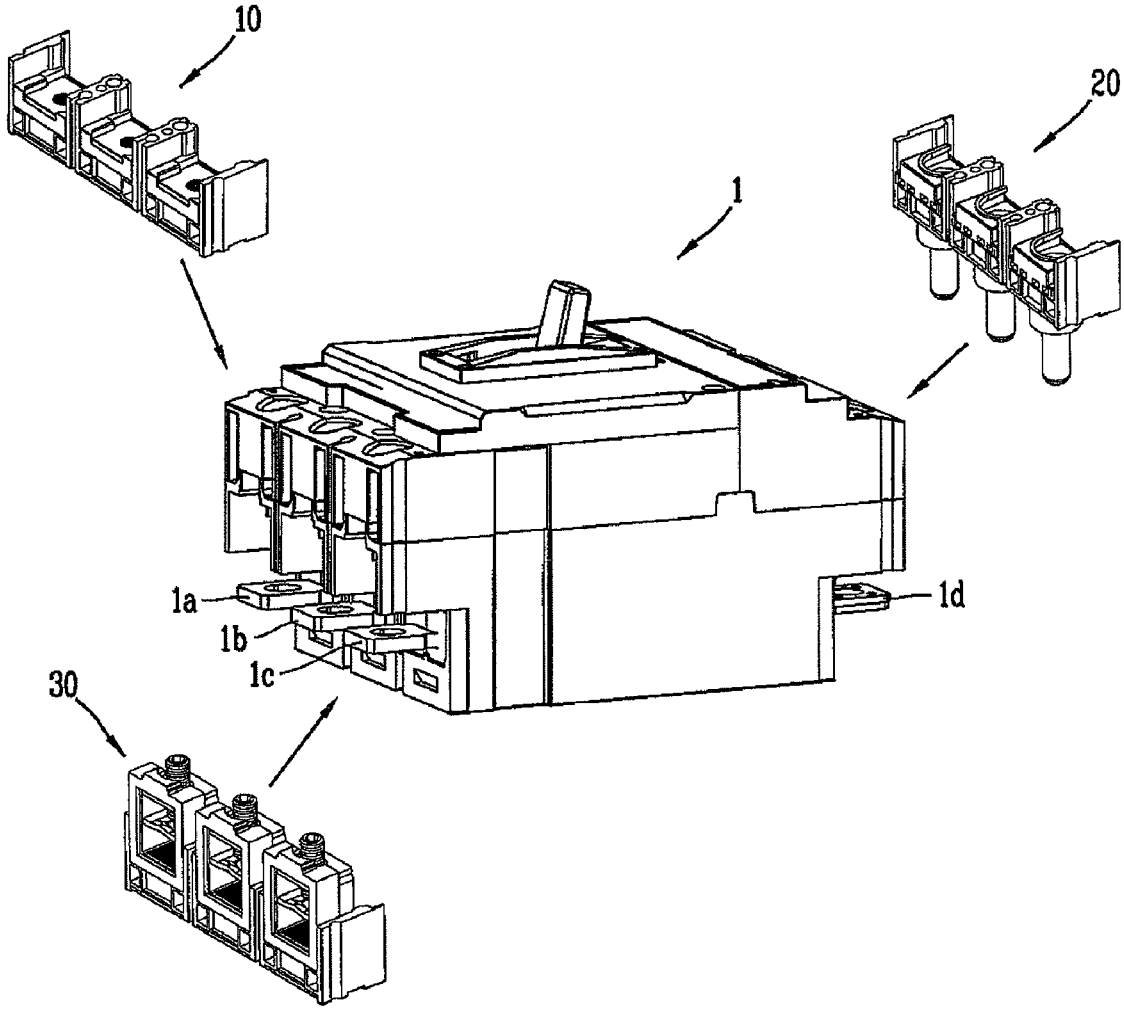
FIG. 1 is a view illustrating that a terminal module assembly for a molded case circuit breaker is selectively installable to the molded case circuit breaker.

FIG. 1 illustrates that a terminal module assembly for a molded case circuit breaker is selectively installable to the molded case circuit breaker. As illustrated in FIG. 1, end portions 1*a* to 1*d* of 3-phase (i.e., R, S and T) of fixed contactors of a molded case circuit breaker 1 are protruded to the outside of the molded case circuit breaker 1.

Assuming that the end portions 1*a* to 1*c* of the fixed contactors of the three end portions in FIG. 1 are end portions for connecting power source side wires, FIG. 1 shows only the end portion 1*d* for connecting a load side wire.

It can be seen in FIG. 1 that a standard type terminal module assembly 10, a plug-in type terminal module assembly 20 and a box type terminal module assembly 30, in each of which three phases are monolithically assembled, can respectively simply be mounted at the three end portions 1*a* to 1*c* of the power source side fixed contactors of the molded case circuit breaker 1 and three end portions (i.e., 1*d* and two other end portions not shown) of the load side fixed contactors.

Figure 2:
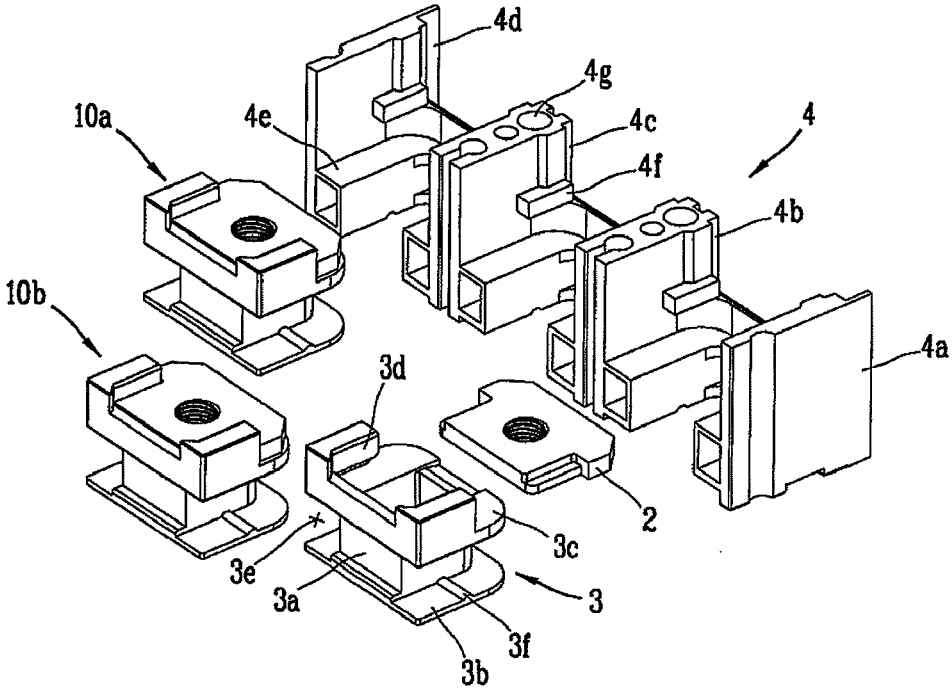
FIG. 2 is an exploded perspective view illustrating a construction and assembly of a standard type terminal module assembly according to the present invention.

FIG. 2 is an exploded perspective view illustrating a construction and assembly of a standard type terminal module assembly according to the present invention. Referring to FIG. 2, the construction and an assembling operations of the standard type terminal module assembly will be described hereinafter.

The standard type terminal module assembly according to the present invention, as illustrated in FIG. 2, may generally include a standard type terminal 2, a standard type terminal base 3 and a common supporting base 4.

The standard type terminal 2 as an electrical conductor is formed to be flat and almost T-shaped, and assembled to the standard type terminal base 3.

At both side portions of the standard type terminal 2 are provided sliding insertion protrusions (numeral is not designated) which are formed to be stepped so as to be slidingly inserted into the standard type terminal base 3.

The standard type terminal base 3 may include a body portion 3*a*, a bottom plate 3*b* horizontally extended outwardly from the bottom of the body portion 3*a* in all directions, a top plate 3*c* horizontally extended outwardly from the top of the body portion 3*a* in all directions, and guide protrusions 3*d* upwardly extended from both side surfaces of the top plate 3*c*, and forming a guide groove together with the top plate 3*c*, so as to guide and support the standard type terminal 2, the guide groove in which the sliding insertion protrusions provided at both the side portions of the standard type terminal 2 are inserted.

Slide grooves 3*e*, which allows the standard type terminal base 3 to be mounted at the common supporting base 4, are formed at both sides of the standard type terminal base 3 by both side surfaces of the body portion 3*a* and the bottom and top plates 3*b* and 3*c* each extended outwardly from the body portion 3*a*.

The guide groove formed by the guide protrusion 3*d* and the upper surface of the top plate 3*c* may have a height higher than the thickness of the standard type terminal 2 by a predetermined tolerance.

Contact-intensifying protrusions 3*f* are provided at central portions on upper surfaces of both sides of the bottom plate 3*b* in a length direction of the bottom plate 3*b*. Accordingly, when the standard type terminal base 3 is assembled to the common supporting base 4, the contact force can be intensified such that the standard type terminal base 3 can firmly be assembled to the common supporting base 4.

The common supporting base 4 comprises outer walls 4*a* and 4*d*, and inner walls 4*b* and 4*c* provided between the outer walls 4*a* and 4*d* so as to form terminal installation spaces for each R, S or T phase together with the outer walls 4*a* and 4*d*.

A pair of rails 4*e* inserted into the slide grooves 3*e* of the standard type terminal base 3 are provided respectively between the outer wall 4*a* and the inner wall 4*b*, between the outer wall 4*d* and the inner wall 4*c* and between the inner walls 4*b* and 4*c* of the common base 4.

The upper surface of the rail 4*e* may function as a supporter on which the upper plate 3*c* of the standard type terminal base 3 is supported (placed).

The rails 4*e* of the common supporting base 4 can be inserted into the slide grooves 3*e* of the standard type terminal base 3 because the slide groove 3*e* of the standard type terminal base 3 is configured to have a height slightly higher than the height of the rail 4*e* by a predetermined tolerance.

At a position spaced apart from an upper surface of the rail 4*e* by a predetermined distance on each inner surface of the outer walls 4*a* and 4*d* and the inner walls 4*b* and 4*c*, a stopper 4*f* is disposed to determine an insertion limit of the standard type terminal base 3 when assembling the standard type terminal base 3 to the common supporting base 4.

The predetermined distance between the upper surface of the rail 4*e* and the stopper 4*f* is determined to be greater by a predetermined tolerance than the sum of the thickness of the upper plate 3*c* of the standard type terminal base 3 and the thickness of the standard type terminal 2.

The reference numeral 4*g* on each of the inner walls 4*b* and 4*c* of the common supporting base 4 designates a screw insertion hole in which a screw S for assembling a terminal module assembly is inserted so as to assemble the standard terminal module assembly 10 to a molded case circuit breaker, in particular, a terminal part insulating partition wall (corresponding to a portion of the partition protruded forwardly above the end portions 1*a* to 1*c* of the fixed contactors in FIG. 1).

The assembling method of the standard type terminal module assembly according to the present invention having such construction will be described as follows.

First, the insertion protrusions of the standard type terminal 2 are slidably inserted into the guide groove formed by the guide protrusions 3*d* and the upper surface of the upper plate 3*c*, thereby assembling the standard type terminal 2 to the standard type terminal base 3.

By the assembly process, standard type terminal module intermediate assemblies 10*a* and 10*b* are made.

The standard type terminal module intermediate assembly 10*a* or 10*b* is assembled for each phase. The assembled standard type terminal module intermediate assemblies 10*a* and 10*b* are inserted between the outer wall 4*a* and the inner wall 4*b* of the common supporting base 4, between the outer wall 4*d* and the inner wall 4*c* and between the inner walls 4*b* and 4*c* of the common supporting base 4, such that the rails 4*e* can be inserted into the slide grooves 3*e* of the standard type terminal base 3, thereby obtaining the standard type terminal module assembly 10 as illustrated in FIG. 3.

Figure 3:
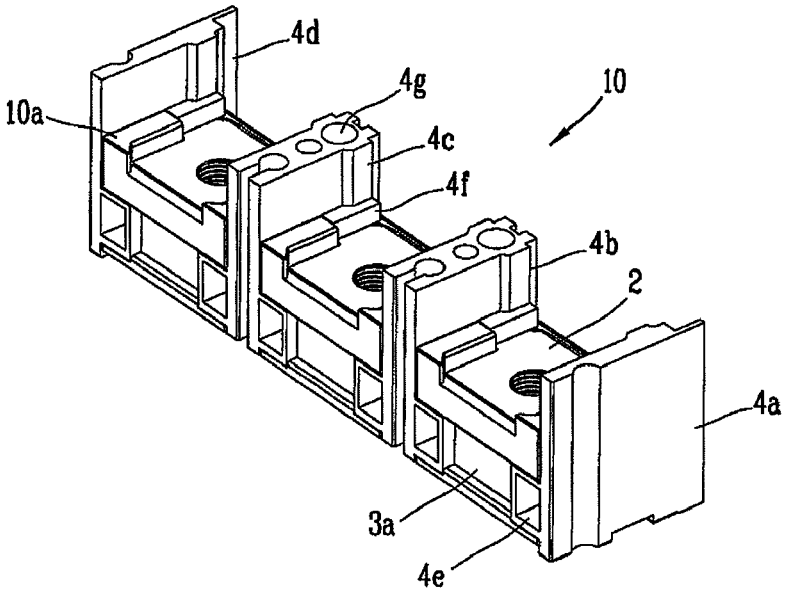
FIG. 3 is a perspective view illustrating a assembled state of the standard type terminal module assembly according to the present invention.

FIG. 3 is a perspective view illustrating an assembled state of the standard type terminal module assembly according to the present invention.

As illustrated in FIG. 3, each phase standard type terminal module intermediate assembly is inserted between the outer wall 4*a* and the inner wall 4*b* of the common supporting base 4, between the outer wall 4*d* and the inner wall 4*c* and between the inner walls 4*b* and 4*c*.

In FIG. 3, the numeral 10*a* is given to only one of the standard type terminal module intermediate assemblies according to each phase.

It can be seen in FIG. 3 that the stoppers 4*f* restrict the insertion of the standard type terminal module intermediate assemblies, and the standard type terminal 2 is mounted below the stoppers 4*f*. Also, it can be seen in FIG. 3 that the body portion 3*a* is inserted between a pair of rails 4*e*.

The unexplained reference numeral 4*g* in FIG. 3 designates the screw insertion hole for fixing the standard type terminal module assembly 10 to the molded case circuit breaker, which horizontally penetrates through each of the inner walls 4*b* and 4*c*.

Figure 4:
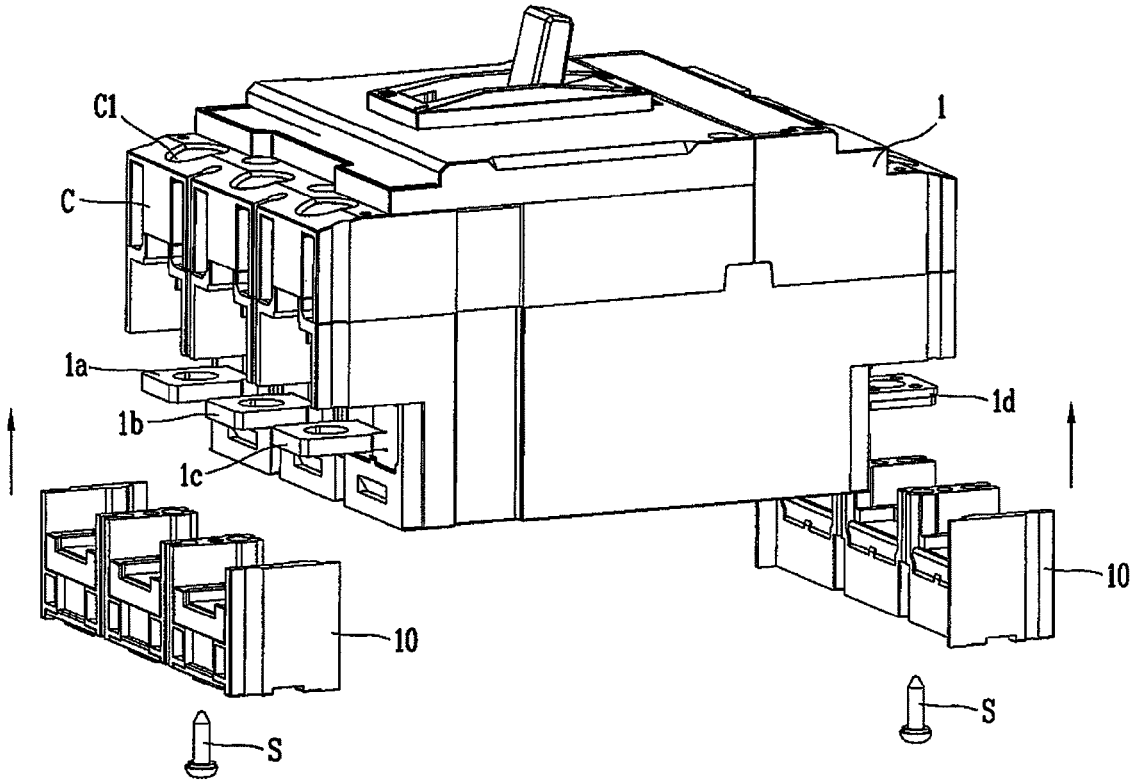
FIG. 4 is a view illustrating a method for assembling the standard type terminal module assembly to a molded case circuit breaker according to the present invention.

FIG. 4 is a view illustrating a method for assembling the standard type terminal module assembly to a molded case circuit breaker according to the present invention.

Two standard type terminal module assemblies 10 are inserted upwardly (i.e., in a direction indicated by arrows) into the lower portion of the molded case circuit breaker 1 such that inner walls and outer walls of each of the standard type terminal module assemblies 10 can come in contact with the terminal part insulating partition walls of the molded case circuit breaker 1 (i.e., the walls extended downwardly from a terminal cover C in FIG. 4).

1 screw S or 2 screws S for assembling a terminal module assembly, for example, per each standard type terminal module assembly 10 in FIG. 4, are tightened by a screw driver such that the screws can be inserted into screw insertion holes of the molded case circuit breaker 1 via the screw insertion holes of FIGS. 2 and 3, thereby completely assembling the standard type terminal module assemblies 10 to the molded case circuit breaker 1.

The standard type terminal module assembly 10 can be separated from the molded case circuit breaker 1 in reverse order of the assembly.

Upon completing the assembly process, the end portions 1*a* to 1*d* of the power source side fixed contactors and the load side fixed contactors of the molded case circuit breaker 1 can electrically and mechanically be in contact with the standard type terminal 2 of the standard type terminal module assembly 10.

Description will be given of a method for connecting wires of a power source side or load side circuit after completely assembling the standard type terminal module assembly 10 according to the present invention to the molded case circuit breaker 1 as follows.

That is, an end portion of a wire is placed on each end portion 1*a* to 1*d* of the fixed contactors. A screw driver is inserted into a screw driver insertion hole C1 of the terminal cover C to tighten a screw (not shown). Accordingly, the wire of the power source side or load side circuit is interposed between the head portion of the screw and each end portion 1*a* to 1*d* of the fixed contactors, thus to be connected.

The wire may be separated in reverse order of the connection.

Figure 5:
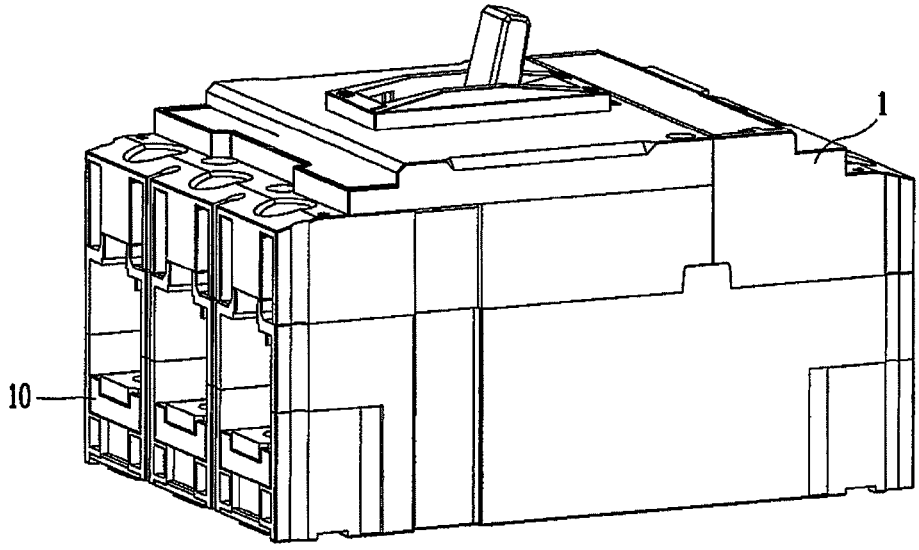
FIG. 5 is a perspective view illustrating one embodiment of a molded case circuit breaker according to the present invention in a state that a standard terminal module assembly is mounted at the molded case circuit breaker.

FIG. 5 is a perspective view illustrating one embodiment of a molded case circuit breaker according to the present invention in a state that a standard terminal module assembly is connected to the molded case circuit breaker. As illustrated in FIG. 5, the standard type terminal module assembly 10 is in a state of being completely assembled to the molded case circuit breaker 1. This state may designates a state that the wire of the power source side or load side circuit can be connected.

Figure 6:
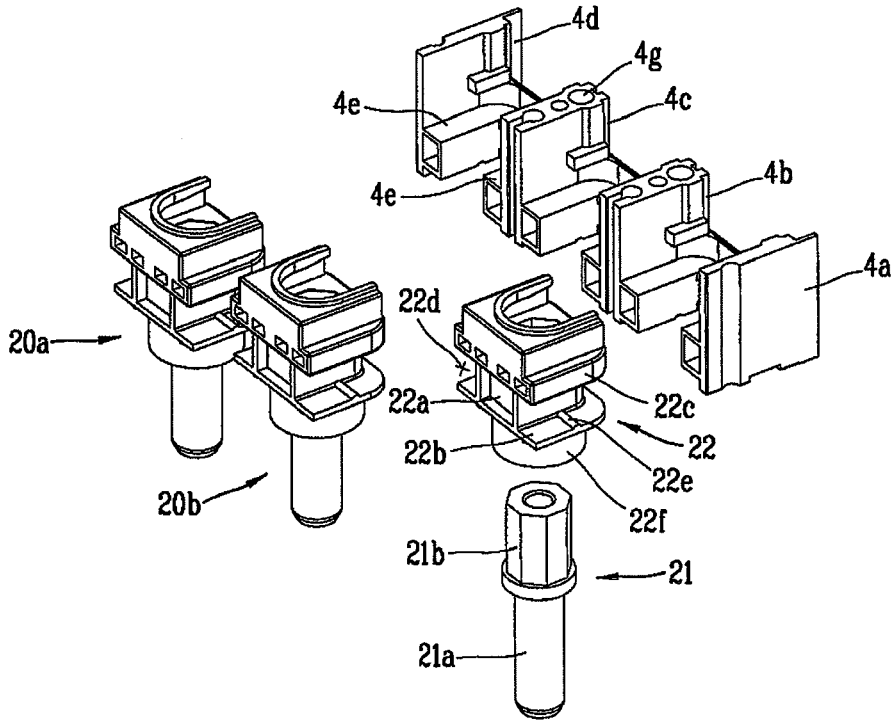
FIG. 6 is an exploded perspective view illustrating a construction and assembly of a plug-in type terminal module assembly according to the present invention.

FIG. 6 is an exploded perspective view illustrating a construction and assembly of a plug-in type terminal module assembly according to the present invention. The construction and the assembly of the plug-in type terminal module assembly according to the present invention will be described with reference to FIG. 6 as follows.

As illustrated in FIG. 6, the plug-in type terminal module assembly according to the present invention may include a plug-in type terminal 21, a plug-in type terminal base 22 and a common supporting base 4.

The plug-in type terminal 21 may include a plug portion 21*a* implemented as a pin-shaped electrical conductor, and a base connection portion 21*b* extended from the plug portion 21*a*. The plug-in type terminal 21 is assembled to the plug-in type terminal base 22.

A jaw portion (reference numeral not designated) is provided between the plug portion 21*a* and the base connection portion 21*b* so as to determine an insertion length of the base connection portion 21*b* when inserting the base connection portion 21*b* into the plug-in type terminal base 22.

The base connection portion 21*b* of the plug-in type terminal 21 is preferably formed in an octagonal or hexagonal pillar shape.

The base connection portion 21*b* is forcibly inserted into its corresponding hole, which is formed through the plug-in type terminal base 22 in a plug portion connecting extended portion 22*f*.

Accordingly, the base connection portion 21*b* of the plug-in type terminal 21 is assembled to the plug-in type terminal base 22, thereby obtaining plug-in type terminal module intermediate assemblies 20*a* and 20*b*.

The plug-in type terminal base 22 comprises a body portion 22*a*, a bottom plate 22*b* horizontally extended outwardly from the bottom of the body portion 22*a* in all directions, a top plate 22*c* horizontally extended outwardly from the top of the body portion 22*a* in all directions.

Slide grooves 22*d*, which allows the plug-in type terminal base 22 to be mounted at the common supporting base 4, are formed at both sides of the plug-in type terminal base 22 by both side surfaces of the body portion 22*a* and the bottom and top plates 22*b* and 22*c* each extended outwardly from the body portion 22*a*.

Contact-intensifying protrusions 22*e* are provided at central portions on upper surfaces of both sides of the bottom plate 22*b* in a length direction of the bottom plate 22*b*. Accordingly, when the plug-in type terminal base 22 is assembled to the common supporting base 4, the contact force can be intensified such that the plug-in type terminal base 22 can firmly be assembled to the common supporting base 4.

The common supporting base 4 may include outer walls 4*a* and 4*d*, and inner walls 4*b* and 4*c* provided between the outer walls 4*a* and 4*d* so as to form terminal installation spaces for each R, S or T phase together with the outer walls 4*a* and 4*d*.

A pair of rails 4*e* inserted into the slide grooves 22*d* of the plug-in type terminal base 22 are provided respectively between the outer wall 4*a* and the inner wall 4*b*, between the outer wall 4*d* and the inner wall 4*c* and between the inner walls 4*b* and 4*c*.

The upper surface of the rail 4*e* may function as a supporter on which the upper plate 22*c* of the plug-in type terminal base 22 is supported (placed).

The rails 4*e* of the common supporting base 4 can be inserted into the slide grooves 22*d* of the plug-in type terminal base 22 because the slide groove 22*d* of the plug-in type terminal base 22 is configured to have a height slightly higher than the height of the rail 4*e* by a predetermined tolerance.

The reference numeral 4*g* on each of the inner walls 4*b* and 4*c* of the common supporting base 4 designates a screw insertion hole, in which a screw S for assembling a terminal module assembly is inserted so as to assemble the plug-in type terminal based 22 to a molded case circuit breaker, in particular, a terminal part insulating partition wall (corresponding to a portion of the partition protruded forwardly above the end portions 1*a* to 1*c* of the fixed contactors in FIG. 1).

The assembling method of the standard type terminal module assembly according to the present invention having such construction will be described as follows.

The base connection portion 21*b* of the plug-in type terminal 21 is forcibly inserted into its corresponding hole formed through the plug-in type terminal base 22 in a plug portion connecting extended portion 22*f*.

Accordingly, the plug-in type terminal 21 is assembled to the plug-in type terminal base 22, thereby obtaining plug-in type terminal module intermediate assemblies 20*a* and 20*b*.

The plug-in type terminal module intermediate assemblies 20*a* and 20*b* are assembled to each other according to each phase. The assembled plug-in type terminal module intermediate assemblies 20*a* and 20*b* are inserted between the outer wall 4*a* and the inner wall 4*b* of the common supporting base 4, between the outer wall 4*d* and the inner wall 4*c* and between the inner walls 4*b* and 4*c*.

Figure 7:
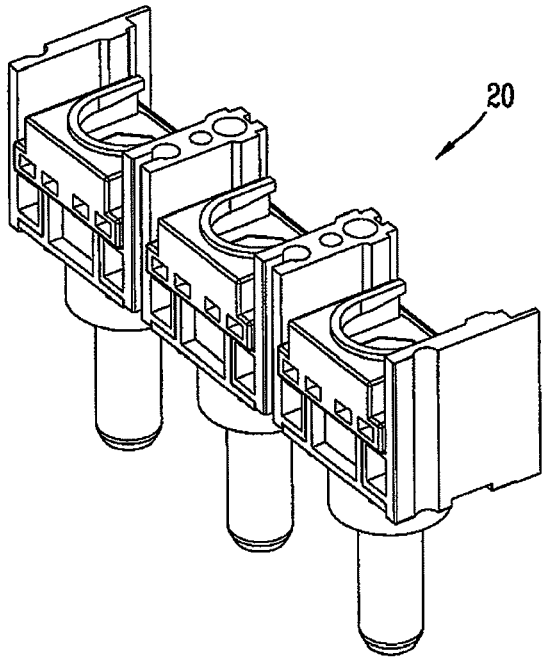
FIG. 7 is a perspective view illustrating an assembled state of a plug-in type terminal module assembly according to the present invention.

Accordingly, the plug-in type terminal module assembly according to the present invention can be obtained as illustrated in FIG. 7.

FIG. 7 is a perspective view illustrating an assembled state of a plug-in type terminal module assembly according to the present invention.

A method for assembling a plug-in type terminal module assembly to a molded case circuit breaker according to the present invention will be described with reference to FIGS. 8 and 9.

Figure 8:
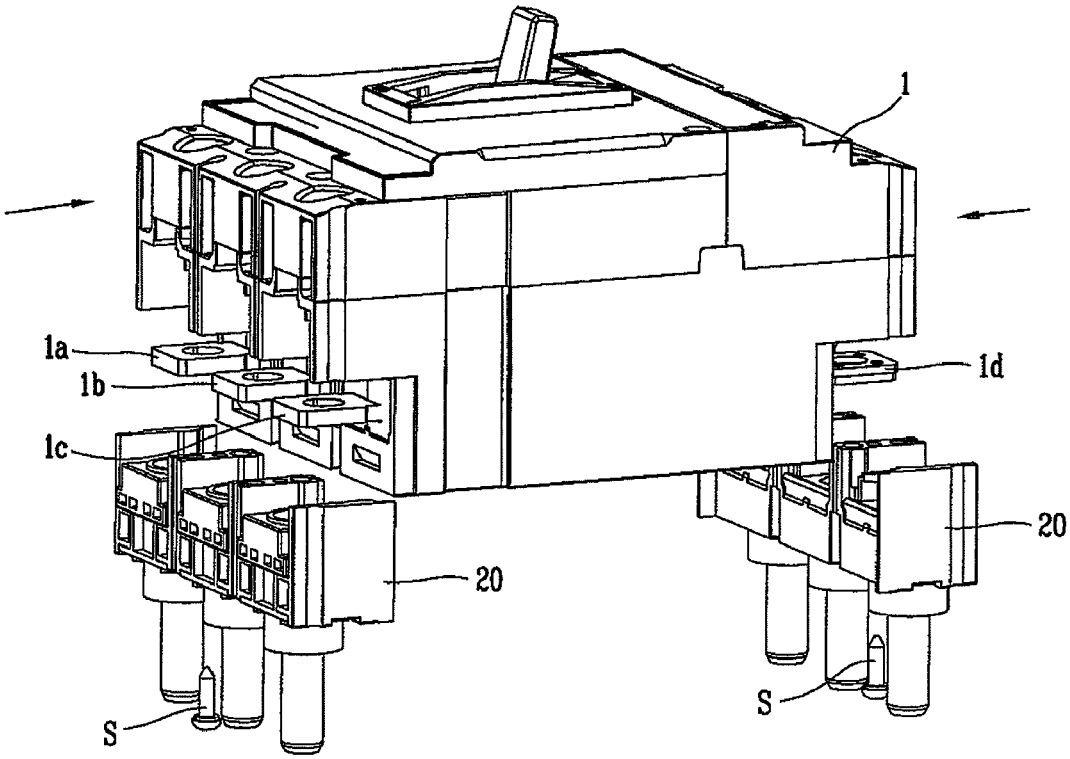
FIG. 8 is a view illustrating a method for assembling the plug-in type terminal module assembly to a molded case circuit breaker according to the present invention.
Figure 9:
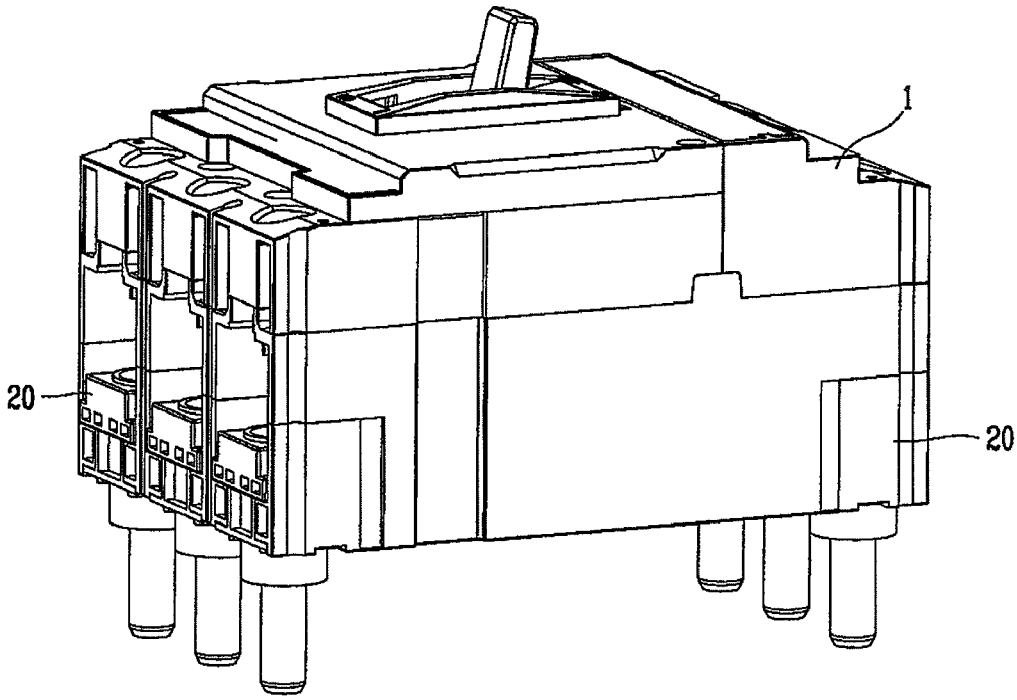
FIG. 9 is a perspective view illustrating another embodiment of a molded case circuit breaker according to the present invention in a state that the plug-in type terminal module assembly is completely mounted at the molded case circuit breaker.

FIG. 8 illustrates a method for assembling the plug-in type terminal module assembly to the molded case circuit breaker according to the present invention, and FIG. 9 illustrates a state that the plug-in type terminal module assembly is completely connected to the molded case circuit breaker.

Two plug-in type terminal module assemblies 20 are inserted in both directions indicated by arrows) such that inner walls and outer walls of each of the plug-in type terminal module assemblies 20 can come in contact with terminal part insulating partition walls of the molded case circuit breaker 1 (i.e., the walls extended downwardly from a terminal cover C in FIG. 4).

1 screw S or 2 screws S for assembling a terminal module assembly, for example, per each plug-in type terminal module assembly 20 in FIG. 8, are tightened by a screw driver such that the screws can be inserted into screw insertion holes of the molded case circuit breaker 1 via the screw insertion holes of FIG. 6, thereby completely assembling the plug-in type terminal module assemblies 20 to the molded case circuit breaker 1.

The plug-in type terminal module assembly 20 can be separated from the molded case circuit breaker 1 in reverse order of the assembly.

Upon completing the assembly process, the end portions 1*a* to 1*d* of the power source side fixed contactors and the load side fixed contactors of the molded case circuit breaker 1 can electrically and mechanically be in contact with the end portions of the base connection portion 21*b* of the plug-in type terminal 21 of the plug-in type terminal module assembly 20.

A method for connecting a power source side or load side circuit after completely assembling the plug-in type terminal module assembly 20 to the molded case circuit breaker 1 will be described as follows.

That is, the plug-in type terminal (refer to the reference numeral 21 in FIG. 6) of the plug-in type terminal module assembly 20, in more detail, the plug portion 21*a* of the plug-in type terminal 21 is respectively inserted into a power source side insertion hole and a load side insertion hole of a plug-in base (not shown) to thusly be connected with each other.

Conversely, the separation from the circuit can be done by separating the plug portion 21*a* of the plug-in type terminal 21 respectively from the power source side insertion hole and the load side insertion hole.

FIG. 9 is a perspective view illustrating another embodiment of a molded case circuit breaker according to the present invention in a state that the plug-in type terminal module assembly is completely connected to the molded case circuit breaker. The state may designate a state that the power source side or load side circuit can be connected.

Figure 10:
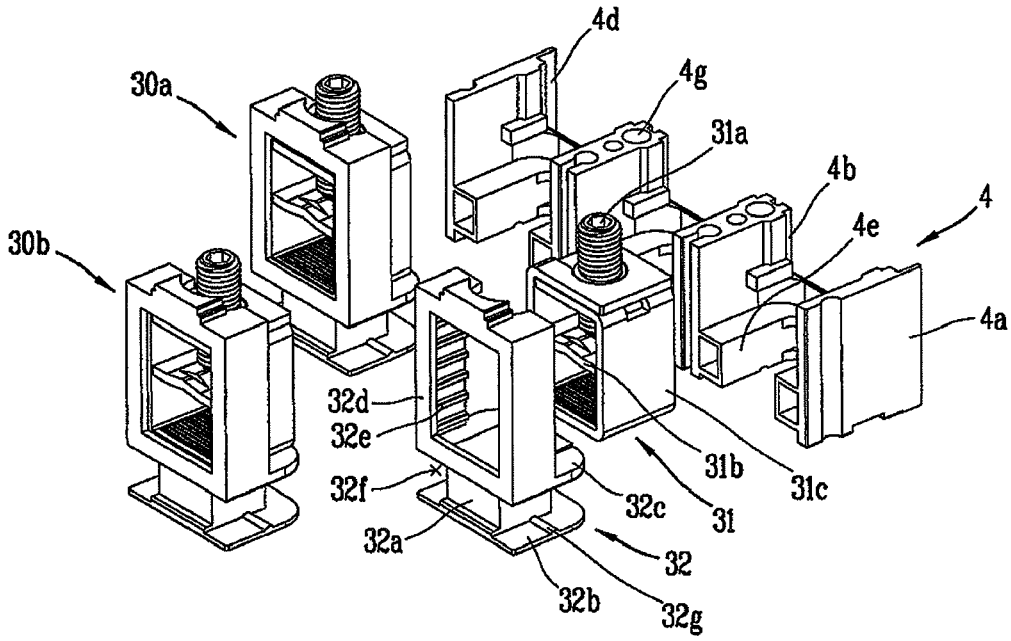
FIG. 10 is an exploded perspective view illustrating a construction and assembly of a box type terminal module assembly according to the present invention.
Figure 11:
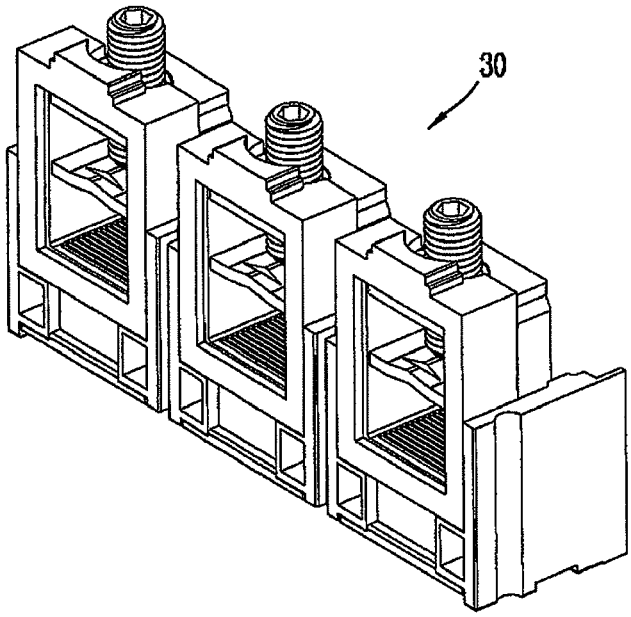
FIG. 11 is a perspective view illustrating an assembled state of the box type terminal module assembly according to the present invention.

FIG. 10 is an exploded perspective view illustrating a construction and assembly of a box type terminal module assembly according to the present invention, and FIG. 11 is a perspective view illustrating an assembled state of the box type terminal module assembly according to the present invention.

Construction and assembly of a box type terminal module assembly according to the present invention will be described with reference to FIGS. 10 and 11 as follows.

As illustrated in FIG. 10, the box type terminal module assembly according to the present invention may include a box type terminal 31, a box type terminal base 32 and a common supporting base 4.

The box type terminal 31 may include a box-shaped body portion 31*c* having front and rear sides communicated and opened, a clamping plate 31*b* movable inside the body portion 31*c* in a longitudinal direction and clamping a wire of a circuit (not shown) to a fixed contact end portion, and a clamping plate driving screw 31*a* connected to the clamping plate 31*b* to be interlocked therewith, and supported by a female screw (not shown) formed above the body portion 31*c*. The box type terminal 31 is then assembled to the box type terminal base 32.

The body portion 31*c* of the box type terminal 31 can be made of an annular soft iron having front and rear sides connected and opened, or be configured by bending a band-type soft iron into the annular shape having its front and rear sides connected and opened, as illustrated in FIG. 10.

The box type terminal base 32 may include a body portion 32*a*, a bottom plate 32*b* horizontally extended outwardly from the lower portion of the body portion 32*a* in all directions, a top plate 32*c* horizontally extended outwardly from the upper portion of the body portion 32*a* in all directions, a window-shaped member 32*d* extended upwardly from the top plate 32*c*, and a plurality of supporting protrusions 32*e* formed at an inner wall in a thickness direction of the window-shaped member 32*d* so as to intensify a contact force (i.e., enlarge a contact area) between the box type terminal base 32 and the body portion 31*c* of the box type terminal 31.

As illustrated in FIG. 10, slide grooves 32*f*, which allows the box type terminal base 32 to be mounted at the common supporting base 4, are formed at both sides of the box type terminal base 32 by both side surfaces of the body portion 32*a* and the bottom and top plates 32*b* and 32*c* each extended outwardly from the body portion 32*a*.

Contact-intensifying protrusions 32*g* are provided at central portions on upper surfaces of both sides of the bottom plate 32*b* in a length direction of the bottom plate 3*b*. Accordingly, when the box type terminal base 32 is assembled to the common supporting base 4, the contact force can be intensified such that the box type terminal base 32 can firmly be assembled to the common supporting base 4.

The common supporting base 4 comprises outer walls 4*a* and 4*d*, and inner walls 4*b* and 4*c* provided between the outer walls 4*a* and 4*d* so as to form terminal installation spaces for each R, S or T phase together with the outer walls 4*a* and 4*d*.

A pair of rails 4*e* inserted into the slide grooves 32*f* of the box type terminal base 32 are provided respectively between the outer wall 4*a* and the inner wall 4*b*, between the outer wall 4*d* and the inner wall 4*c* and between the inner walls 4*b* and 4*c* of the common supporting base 4.

The upper surface of the rail 4*e* may function as a supporter on which the upper plate 32*c* of the box type terminal base 32 is supported (placed).

The rails 4*e* of the common supporting base 4 can be inserted into the slide grooves 32*f* of the box type terminal base 32 because the slide groove 32*f* of the box type terminal base 32 is configured to have a height slightly higher than the height of the rail 4*e* by a predetermined tolerance.

The reference numeral 4*g* on each of the inner walls 4*b* and 4*c* of the common supporting base 4 designates a screw insertion hole, in which a screw S for assembling a terminal module assembly is inserted so as to assemble the box terminal base 32 according to the present invention to a molded case circuit breaker, in particular, a terminal part insulating partition wall (corresponding to a portion of the partition protruded forwardly above the end portions 1*a* to 1*c* of the fixed contact in FIG. 1).

The assembling method of the box type terminal module assembly according to the present invention having such construction will be described as follows.

First, the body portion 31*c* of the box type terminal 31 is inserted into the window-shaped member 32*d* of the box type terminal base 32, to assemble the box type terminal base 32 to the box type terminal 31, thereby obtaining box type terminal module intermediate assemblies 30*a* and 30*b*.

The box type terminal module intermediate assemblies 30*a* and 30*b* are assembled to each other according to each phase.

The assembled box type terminal module intermediate assemblies 30*a* and 30*b* are inserted between the outer wall 4*a* and the inner wall 4*b* of the common supporting base 4, between the outer wall 4*d* and the inner wall 4*c* and between the inner walls 4*b* and 4*c*, so that the rails 4*e* can be inserted into the slide grooves 23*f* of the box type terminal base 32. Accordingly, the box type terminal module assembly can be made as illustrated in FIG. 11.

FIG. 11 is a perspective view illustrating an assembled state of the box type terminal module assembly according to the present invention.

Figure 12:
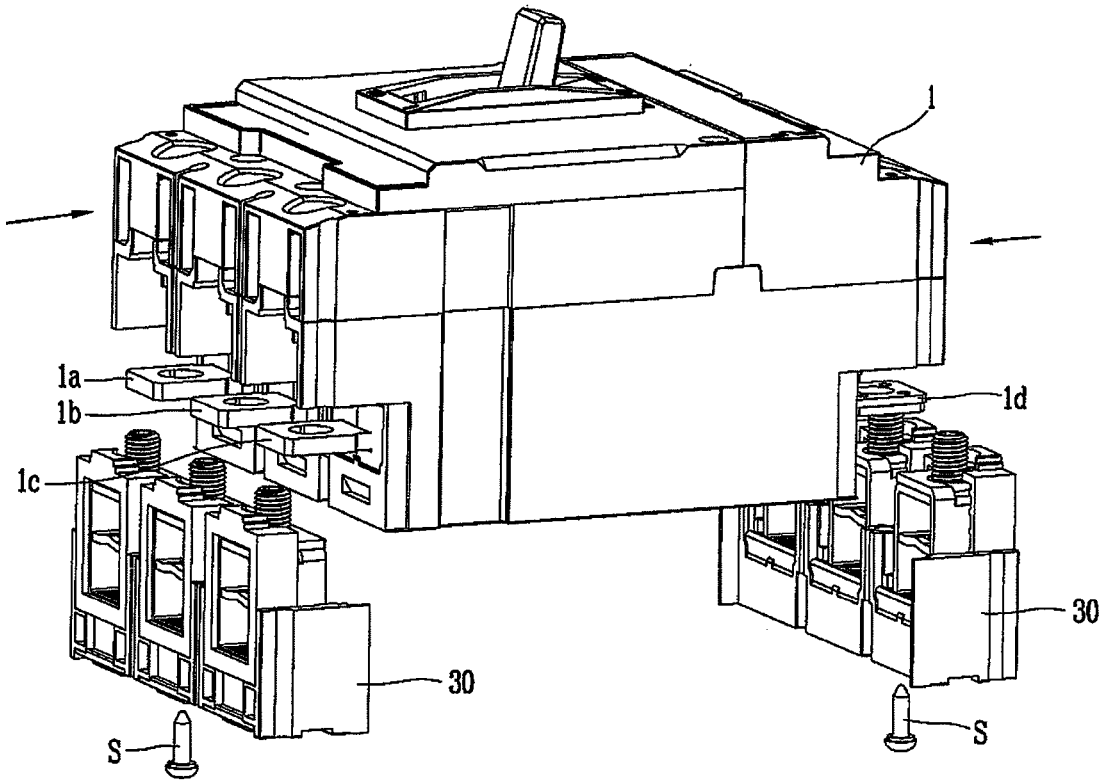
FIG. 12 is a view illustrating a method for assembling the box type terminal module assembly to a molded case circuit breaker according to the present invention.
Figure 13:
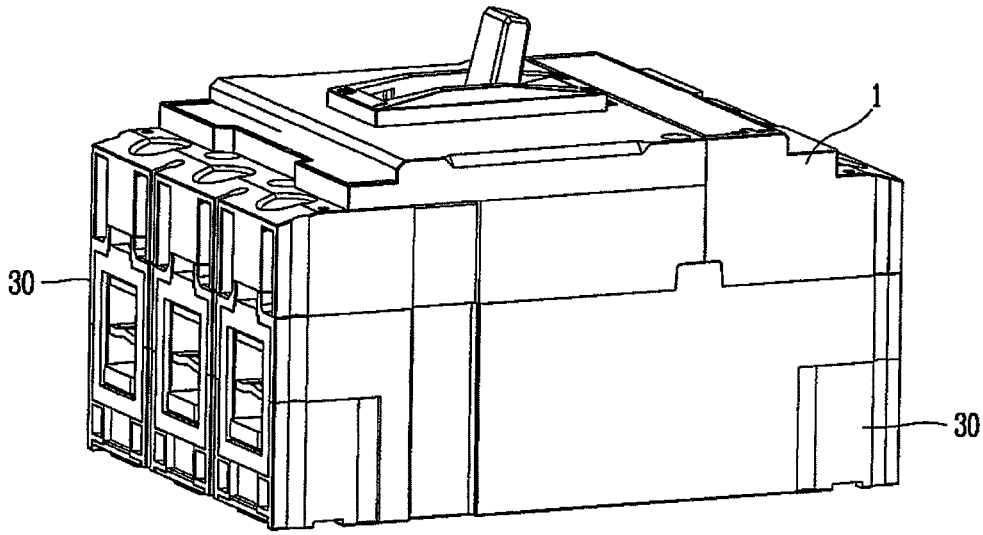
FIG. 13 is a perspective view illustrating another embodiment of a molded case circuit breaker in a state that the box type terminal module assembly is completely mounted at the molded case circuit breaker according to the present invention.

FIG. 12 is a view illustrating a method for assembling the box type terminal module assembly to a molded case circuit breaker according to the present invention, and FIG. 13 is a perspective view illustrating another embodiment of a molded case circuit breaker in a state that the box type terminal module assembly is completely assembled to the molded case circuit breaker according to the present invention. Description of the assembling method will be given with reference to FIGS. 12 and 13 as follows.

Two box type terminal module assemblies 30 for connecting power source side and load side circuits are inserted in both directions indicated by arrows such that inner walls and outer walls of each of the box type terminal module assemblies 30 can come in contact with terminal part insulating partition walls of the molded case circuit breaker 1 (i.e., the walls extended downwardly from a terminal cover C in FIG. 4).

1 screw S or 2 screws S for assembling a terminal module assembly, for example, per each box type terminal module assembly 30 in FIG. 12, are tightened by a screw driver such that the screws can be inserted into screw insertion holes of the molded case circuit breaker 1 via the screw insertion holes 4*g* of FIG. 10, thereby completely assembling the box type terminal module assemblies 30 to the molded case circuit breaker 1.

The box type terminal module assembly 30 can be separated from the molded case circuit breaker 1 in reverse order of the assembly.

Upon completing the assembly process, the end portions 1*a* to 1*d* of the power source side fixed contactors or the load side fixed contactors of the molded case circuit breaker 1 are inserted into the body portion 31*c* of the box type terminal module assembly 30.

A method for connecting a power source side or load side circuit after completely assembling the box type terminal module assembly 30 to the molded case circuit breaker 1 will be described as follows.

First, the screw driver is inserted into a screw driver insertion hole in the terminal cover of the box type module assembly 30 to screw the clamping plate driving screw 31*a*, thereby lifting the clamping plate 31*b* in FIG. 10.

In this state, the power source side wire and the load side wire are respectively placed on the end portions 1*a* to 1*d* of the power source side fixed contactors and on those of the load side fixed contactors. Then, the clamping plate driving screw 31*a* is re-tightened by the screw driver to lower the clamping plate 31*b* in FIG. 10.

Accordingly, the wires are connected between the clamping plate 31*b* and the end portions 1*a* to 1*d* of the fixed contactors, thereby completing an electrical connection between the wires of the circuit and the terminal part of the molded case circuit breaker 1.

Conversely, the wires of the circuit can be separated from the terminal part of the molded case circuit breaker when lifting the clamping plate 31*b* by releasing the clamping plate driving screw 31*a*.

FIG. 13 is a perspective view illustrating another embodiment of a molded case circuit breaker in a state that the box type terminal module assembly is completely assembled to the molded case circuit breaker according to the present invention. This state may designate a state that the power source side or load side circuit can be connected.

Figure 14:
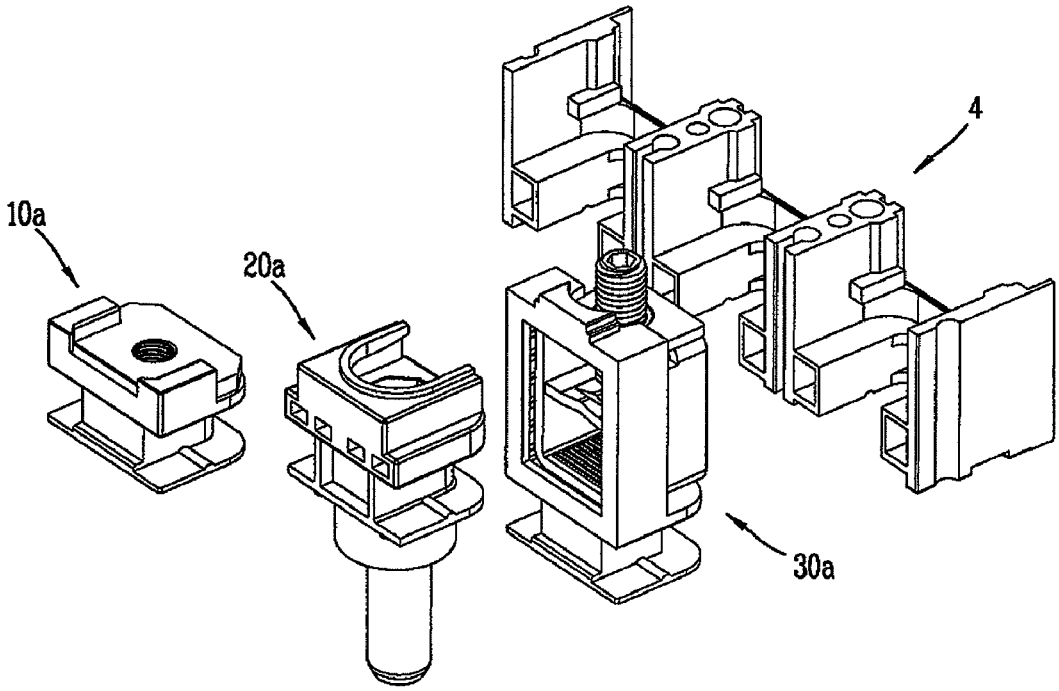
FIG. 14 is an exploded perspective view illustrating that a terminal module assembly for a molded case circuit breaker can be configured by assembling three different types of terminal modules (i.e., standard, plug-in and box) in combination to one common supporting base according to the present invention.
Figure 15:
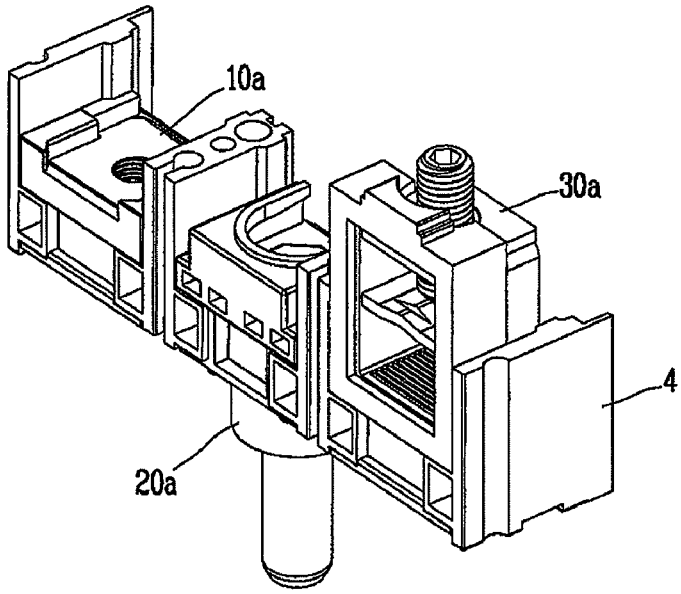
FIG. 15 is a perspective view illustrating a completely assembled terminal module assembly for a molded case circuit breaker in which three different types of terminal modules (i.e., standard, plug-in and box) are all mounted in combination at one common supporting base according to the present invention.

On the other hand, as illustrated in FIGS. 14 and 15, to one common supporting base 4, as a common mounting platform for three different phase terminal modules, can be assembled the standard type terminal module intermediate assembly 10*a*, the plug-in type terminal module intermediate assembly 20*a*, and the box type terminal module intermediate assembly 30*a*.

That is, according to the present invention, the standard type terminal module intermediate assembly 10*a* may be mounted in the R-phase of the common supporting base 4 as the common mounting platform, the plug-in type terminal module intermediate assembly 20*a* may be mounted in the S-phase of the common supporting base 4, and the box type terminal module intermediate assembly 30*a* may be mounted in the T-phase of the common supporting base 4.

Figure 16:
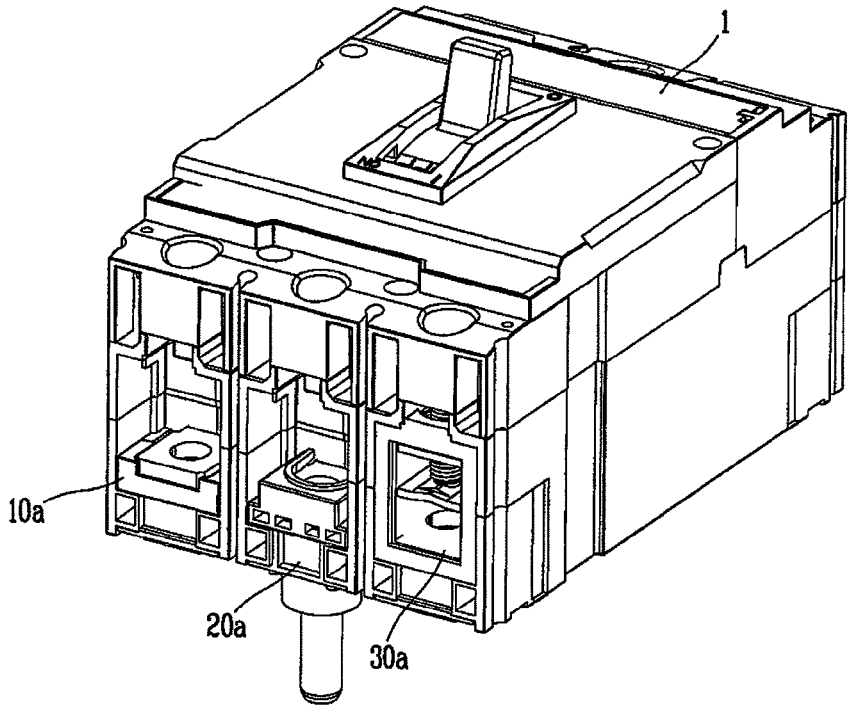
FIG. 16 is a perspective view illustrating that a terminal module assembly, in which three different types of terminal modules (i.e., standard, plug-in and box) are all mounted in combination a one common supporting base, is mounted at a molded case circuit breaker according to the present invention.

The terminal module assembly, in which the standard type terminal module intermediate assembly 10*a* is mounted in the R-phase of the common supporting base 4, the plug-in type terminal module intermediate assembly 20*a* is mounted in the S-phase of the common supporting base 4, and the box type terminal module intermediate assembly 30*a* is mounted in the T-phase of the common supporting base 4 as illustrated in FIGS. 14 and 15, can be assembled to terminal part of the molded case circuit breaker 1 as illustrated in FIG. 16, according to the method previously described.

Figure 17:
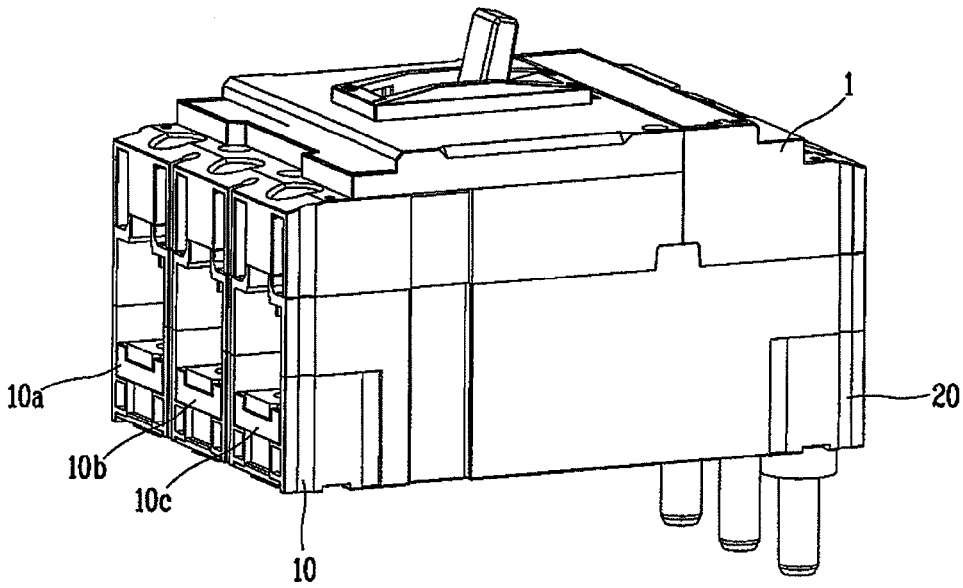
FIG. 17 is a perspective view illustrating an example in which a standard type terminal module assembly is mounted at a power source side connection terminal part of a molded case circuit breaker, and a plug-in type terminal module assembly is mounted at a load side connection terminal part of the molded case circuit breaker, according to the present invention.

In addition, it is available that the standard type terminal module assembly 10 is mounted at the power source side terminal part, and the plug-in type terminal module assembly is mounted at the load side terminal part, of the terminal parts of the molded case circuit breaker 1 as illustrated in FIG. 17.

As described above, in providing the terminal module assembly and the molded case circuit breaker having the same according to the present invention, the terminal module can be constructed as a three-phase integrated assembly with respect to each of the power source side and the load side of the molded case circuit breaker, manufacturers can simplify the manufacturing, packaging and selling, and the users can simply replace only the terminal part with his desired type of the terminal part.

In addition, the terminal modules assembled to the terminal module assembly can be variously selected according to each phase or according to power source side or load side. Accordingly, the terminal module assembly which can be constructed according to the installation environment of the molded case circuit breaker and the molded case circuit breaker having the same can be provided.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A terminal module assembly for a molded case circuit breaker connected to fixed contactors of the molded case circuit breaker comprising:

a plurality of terminals which are provided as many as the number of the fixed contactors provided each phase, and electrically connected to the fixed contactors, wherein each of the plurality of terminals selectively has a standard type, a plug-in type and a box type;

a plurality of terminal bases which are provided as many as the number of the terminals for fixedly supporting each of the terminals, and provided to selectively have the standard type, the plug-in type and the box type corresponding to the types of the terminals selected from the standard type, the plug-in type and the box type, wherein each terminal and the each terminal base are assembled to each other to obtain a terminal module intermediate assembly; and a common supporting base which supports all the intermediate assemblies regardless of the type of the terminal or terminal base, wherein the intermediate assemblies are assembled to the common supporting base to obtain a complete terminal module assembly, such that the standard, plug-in or box type terminal module assembly is selectively able to be mounted in the molded case circuit breaker or separated from the molded case circuit breaker without opening the case of the molded case circuit breaker.

2. The assembly of claim 1, wherein the box type terminal base comprises a window-shaped member having a plurality of supporting protrusions for supporting the box type terminal such that the box type terminal is prevented from being fluctuated.

3. A molded case circuit breaker having a terminal module assembly comprising:

a plurality of fixed contactors which are provided according to each phase and have end portions protruded to the outside of the molded case circuit breaker so as to be connected to a power source or load side wires;

a terminal module assembly which is electrically connected to the end portions of the fixed contactors and selectively has a standard type, a plug-in type or a box type to be mounted in the molded case circuit breaker or separated therefrom, wherein the terminal module assembly comprises:

a plurality of terminals which are provided as many as the number of the fixed contactors, selectively have the standard type, the plug-in type or the box type, and electrically connected to the end portions of the fixed contactors;

a plurality of terminal bases which are provided as many as the number of the terminals for fixedly supporting each of the terminals, and provided to selectively have the standard type, the plug-in type and the box type corresponding to the types of the terminals selected from the standard type, the plug-in type and the box type, wherein each terminal and the each terminal base are assembled to each other to obtain a terminal module intermediate assembly; and a common supporting base which supports all the intermediate assemblies regardless of the type of the terminal or terminal base, wherein the intermediate assemblies are assembled to the common supporting base to obtain a complete terminal module assembly, such that the standard, plug-in or box type terminal module assembly is selectively able to be mounted in the molded case circuit breaker or separated from the molded case circuit breaker without opening the case of the molded case circuit breaker.

4. The circuit of claim 3, wherein the box type terminal base comprises a window-shaped member which has a plurality of supporting protrusions for supporting the box type terminal such that the box type terminal is prevented from being fluctuated.

* * * * *